US007355557B2

(12) United States Patent
Noro et al.

(10) Patent No.: US 7,355,557 B2
(45) Date of Patent: Apr. 8, 2008

(54) ANTENNA UNIT AND FEEDING COMPONENT

(75) Inventors: Junichi Noro, Akita (JP); Kyuichi Sato, Akita (JP); Nobuaki Monma, Akita (JP); Shozo Miyamoto, Akita (JP); Takumi Suzuki, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 265 days.

(21) Appl. No.: 11/320,086

(22) Filed: Dec. 28, 2005

(65) Prior Publication Data

US 2006/0214852 A1 Sep. 28, 2006

(30) Foreign Application Priority Data

Mar. 28, 2005 (JP) ..... 2005-090852

(51) Int. Cl.
*H01Q 1/38* (2006.01)

(52) U.S. Cl. ..... 343/846; 343/872; 343/767

(58) Field of Classification Search ..... 343/846, 343/872, 848, 767, 789, 700 MS, 829–830
See application file for complete search history.

(56) References Cited

U.S. PATENT DOCUMENTS 5,181,044 A * 1/1993 Matsumoto et al. ..... 343/752
6,049,314 A * 4/2000 Munson et al. ..... 343/846
6,133,883 A * 10/2000 Munson et al. ..... 343/700 MS
6,246,368 B1 * 6/2001 Deming et al. ..... 343/700 MS
6,861,990 B2 * 3/2005 Hung et al. ..... 343/702
6,879,288 B2 * 4/2005 Byrne et al. ..... 343/700 MS

FOREIGN PATENT DOCUMENTS

JP 2005-020644 A 1/2005

* cited by examiner

*Primary Examiner*—Douglas W. Owens
*Assistant Examiner*—Chuc Tran
(74) *Attorney, Agent, or Firm*—Frishauf, Holtz, Goodman & Chick, P.C.

(57) ABSTRACT

A feeding component 40 has a wire (or a feeding line) 42 and an attaching member 43 made of resin. The attaching member 43 provides wire receiving grooves 43*a* and 43*b* to receive and support the wire 42. At least one pair of wire holding parts 43*d* are formed on inner wall defining the wire receiving grooves 43*a* and 43*b*. The wire holding parts 43*d* of each pair are opposite to each other and inclined to narrow a width of the wire receiving groove 43*a* or 43*b* with increasing proximity to an upper side of the wire receiving groove 43*a* or 43*b*. The wire holding parts 43*d* hold the wire 42 put into the wire receiving grooves 43*a* and 43*b*.

8 Claims, 4 Drawing Sheets

ANTENNA UNIT AND FEEDING COMPONENT

This application claims priority to prior application JP 2005-90852, the disclosure of which is incorporated herein by reference.

BACKGROUND OF THE INVENTION

This invention relates to an antenna unit and a feeding component included therein, particularly, to a satellite signal receiving antenna unit for receiving a circular polarized wave such as a satellite radio broadcast.

A GPS (Global Positioning System) receiving antenna is currently known as an example of an antenna for receiving a radio wave from an artificial satellite. As the GPS receiving antenna, what is called a patch antenna is used, for example. The patch antenna has a ceramic board, which is an insulating material, with a pair of main surfaces. On one of the main surfaces of the ceramic board, a ground electrode is provided. On the other of the main surfaces of the ceramic board, a receiving electrode and a feeding pin are provided. The feeding pin is used for supplying a receiving signal to an external circuit.

Recently, it is propelled to execute a radio broadcast and so on using a circular polarized wave transmitted from the artificial satellite. To receive the radio broadcast, what is called a satellite radio broadcast receiving antenna is used.

The satellite radio broadcast receiving antenna includes a pair of feeding components each of which consists of a feeding line and an attaching member. The feeding line and the attaching member are made of metal and resin, respectively. The feeding line is attached to the attaching member. To stabilize the attaching state of the feeding line to the attaching member, a tape, such as a plastic tape, is applied.

Thus, the satellite radio broadcast receiving antenna needs the tape. Accordingly, the satellite radio broadcast receiving antenna has a problem that components and assembling processes are large in number.

SUMMARY OF THE INVENTION

It is therefore an object of this invention to provide a feeding component which a feeding line can be stably attached to an attaching member without increase of the numbers of components.

Another object of this invention is to provide a feeding component which can be made by a small number of assembling processes.

Still another object of this invention is to provide an antenna unit having the feeding component mentioned above.

Other objects of this invention will become clear as the description proceeds.

According to an aspect of this invention, an antenna unit comprises a first metal plate as a ground electrode. A second metal plate is opposite to the first metal plate. A feeding component is located between the first metal plate and the second metal plate and includes a wire and an attaching member made of resin. The wire has a base end portion and a feeding portion which is continuous with the base end portion and which extends in a plane. The attaching member provides a through hole for receiving the base end portion and a wire receiving groove for supporting the feeding portion and has a pair of wire fixing parts which are formed on inner walls defining the wire receiving groove. The wire fixing parts are opposite to each other and inclined inward to narrow a width of the wire receiving groove with increasing proximity to an upper side of the wire receiving groove.

In the antenna unit, a distance between the wire fixing parts may be in a range from $\phi/1.09$ to $\phi/1.2$, where $\phi$ represents a diameter of the wire. Furthermore, the attaching member may provide an opening corresponding to the wire fixing parts at a bottom of the wire receiving groove. Still furthermore, the wire receiving groove may be formed to receive either of the wires which have two symmetric shapes.

According to another aspect of this invention, a feeding component comprises a wire having a base end portion and a feeding portion which is continuous with the base end portion and which extends in a plane. An attaching member is made of resin. The attaching member provides a through hole for receiving the base end portion and a wire receiving groove for supporting the feeding portion. The attaching member further has a pair of wire fixing parts which are formed on inner walls defining the wire receiving groove. The wire fixing parts are opposite to each other and inclined inward to narrow a width of the wire receiving groove with increasing proximity to an upper side of the wire receiving groove.

In the feeding component, a distance between the wire fixing parts may be in a range from $\phi/1.09$ to $\phi/1.2$, where $\phi$ represents a diameter of the wire. Furthermore, the attaching member may provide an opening corresponding to the wire fixing parts at a bottom of the wire receiving groove. Still furthermore, the wire receiving groove may be formed to receive either of the wires which have symmetric shapes.

DESCRIPTION OF THE PREFERRED EMBODIMENTS

Figure 1:
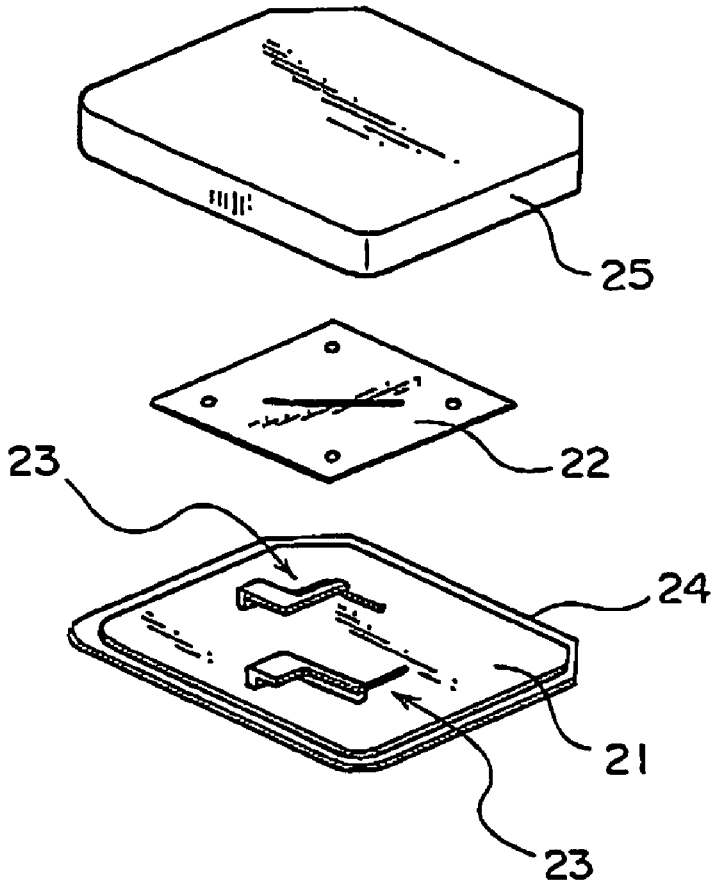
FIG. 1 PRIOR ART
FIG. 1 is an exploded perspective view showing an example of a conventional satellite signal receiving antenna unit.
Figure 2:
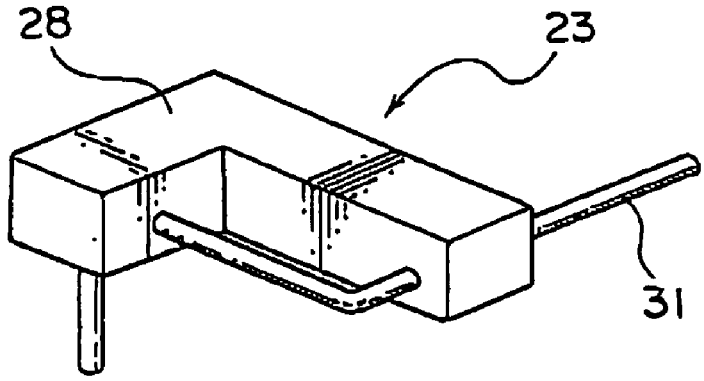
FIG. 2 PRIOR ART
FIG. 2 is an oblique perspective view showing an example of a conventional feeding component.

Referring to FIGS. 1 and 2, a description will be first directed to a conventional satellite radio broadcast receiving antenna unit.

In FIG. 1, the conventional satellite radio broadcast receiving antenna unit has a first metal plate 21 as a ground electrode, a second metal plate 22 which maintain a predetermined distance from the first metal plate 21 to be opposite thereto and which serves as a signal receiving surface, a pair of feeding components 23 disposed in a space between the first and the second metal plates 21 and 22 to feed the second metal plate 22.

The first metal plate 21 is made of metal material and shaped into a rectangular flat plate. The first metal plate 21 is attached to a lower cover 24. On the other hand, the second metal plate 22 is made of metal material and attached to an upper cover 25. The lower cover 24 and the upper cover 25 are assembled to form an internal space which contains the first metal plate 21, the pair of the feeding components 23 and the second metal plate 22.

As illustrated in FIG. 2, each of the feeding components 23 consists of a feeding line 31 and an attaching member 28 which are integrated by insert molding. The feeding line 31 is made of conductive material such as metal and shaped into a wire. The attaching member 28 is made of resin material.

The feeding line 31 has a horizontal part which is supported by the attaching member 28 over a main surface of the first metal plate 21 to be apart from the first metal plate 21.

In the satellite radio broadcast receiving antenna having the structure mentioned above, the feeding components 23 are arranged so that their horizontal parts are perpendicular to each other and thereby good receiving characteristics are obtained regarding to both of right and left circular polarized waves. Accordingly, the feeding lines 31 of the feeding components 23 are attached to the attaching members 28 in symmetrical arrangement. In other words, two types of the feeding components 23 having symmetrical arrangements are necessary to assemble the satellite radio broadcast receiving antenna.

The insert molding, which is used for integrating the feeding line 31 with the attaching member 28, raises manufacturing cost of the satellite radio broadcast receiving antenna. Especially, in a case where two of the feeding components 23 having symmetrical arrangements are necessary to deal with the right and the left circular polarized waves, the insert molding further rises the manufacturing cost because two types of insert molding dies are necessary.

To solve the problems mentioned above, the applicants have already proposed a satellite signal receiving antenna unit which is made by a technique that either of the symmetrical feeding components 23 can be obtained by changing bending direction of a feeding line and thereby the manufacturing cost is considerably reduced. Such an antenna unit is disclosed in Unexamined Japanese Patent Application Publication (JP-A) No. 2005-20644.

Figure 3:
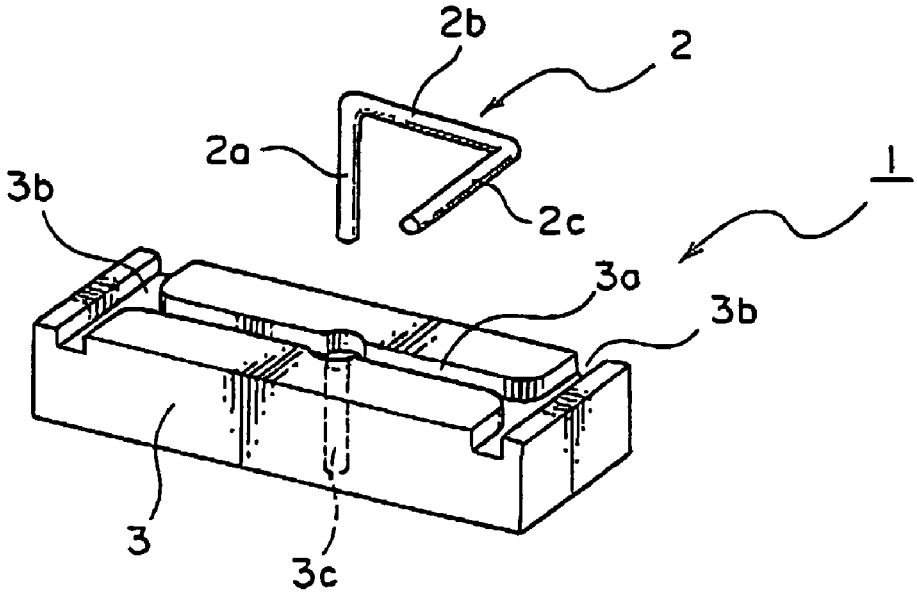
FIG. 3 PRIOR ART
FIG. 3 is an exploded perspective view showing another example of the conventional feeding component used in the conventional satellite signal receiving antenna unit.

FIG. 3 shows a feeding component used in the satellite signal receiving antenna unit disclosed in the above mentioned Publication. The feeding component 1 has a feeding line 2 made of metal and an attaching member 3 made of resin.

The feeding line 2 has a shape bent at two points on the square. Accordingly, the feeding line 2 has a base end portion 2*a* bent in a vertical direction, a supporting portion 2*b* continuing on the base end portion 2*a* and extending on a horizontal plane, and a feeding portion 2*c* bent at a right angle with the supporting portion 2*b* on the horizontal plane.

Figure 4:
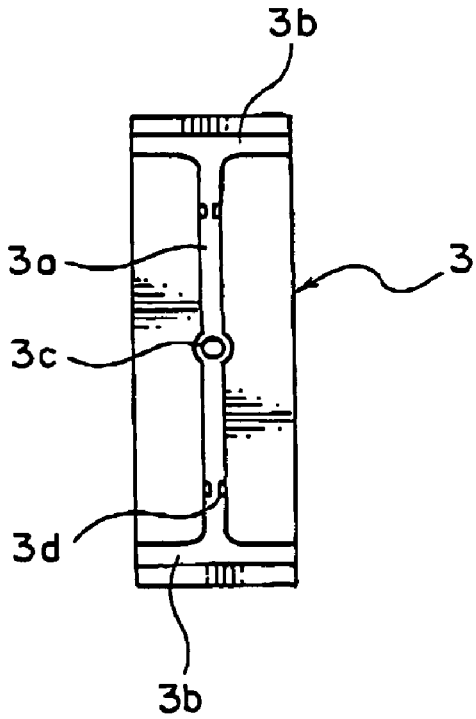
FIG. 4 PRIOR ART
FIG. 4 is a top plan view of an attaching member used for the feeding component shown in FIG. 3.

FIG. 4 is a top plane view of the attaching member 3. The attaching member is a molding body having an almost rectangular parallelepiped shape. At the upper side of the attaching member 3, a first wire receiving groove 3*a* for receiving the supporting portion 2*b* of the feeding line 2 is formed along a longitudinal direction to stretch over almost total length of the attaching member 3. At the ends of the first wire receiving groove 3*a*, to correspond to the feeding portion 2*c* perpendicular to the supporting portion 2*b*, second wire receiving grooves 3*b* perpendicular to the first wire receiving groove 3*a* are formed along a width direction to stretch over total width of the attaching member 3. Here, to deal with the feeding portion 2*c* bent toward either of right and left hand directions regarding the supporting portion 2*b*, the second wire receiving grooves 3*b* are formed to stretch over total width of the attaching member 3. The wire receiving grooves 3*a* and 3*b* allow attaching either of the feeding lines 2 bent in the right and the left hand directions symmetrically to the attaching member 3.

At the middle of the first wire receiving groove 3*a*, a through hole 3*c* is bored through the attaching member 3 along the vertical direction. The through hole 3*c* is for receiving the base end portion 2*a* of the feeding line 2. The base end portion 2*a* inserted into the through hole 3*c* may be connected to a circuit board (not shown) to serve as an signal output electrode of the feeding line 2.

A plurality of tiny projections 3*d* is formed on inner walls defining the first wire receiving groove 3*a* of the attaching member 3. The tiny projections 3*d* press and hold the supporting portion 2*b* put into the first wire receiving groove 3*a* to prevent the supporting portion 2*b* of the feeding line 2 from falling away from the first wire receiving groove 3*a*. Thus, the tiny projections 3*d* allow the feeding line 2 to be fixed to the attaching member 3 without extra parts.

As mentioned above, in the conventional feeding component 1, the plural tiny projections 3*d* projecting into the first wire receiving groove 3*a* hold the supporting portion 2*b* of the feeding line 2 put into the first wire receiving groove 3*a*. Accordingly, it is necessary that the first wire receiving groove 3*a* has a width which is little larger than a diameter of the feeding line 2. This is because the tiny projections 3*d* are obstacles and make hard to put the supporting portion 2*b* of the feeding line 2 into the first wire receiving groove 3*a* when the width of the first wire receiving groove 3*a* is substantially equal to the diameter of the feeding line 2. To the contrary, when the width of the first wire receiving groove 3*a* is too wide in comparison with the diameter of the feeding line 2, it is hard to stably hold the support portion 2*b* of the feeding line 2 in the first wire receiving groove 3*a*.

Therefore, in the conventional feeding component 1, a tape, such as a plastic tape, is affixed to the attaching member 3 to cover the wire receiving grooves 3*a* and 3*b* and to further stabilize an attaching state of the feeding line 2 put in the attaching member 3.

Figure 5:
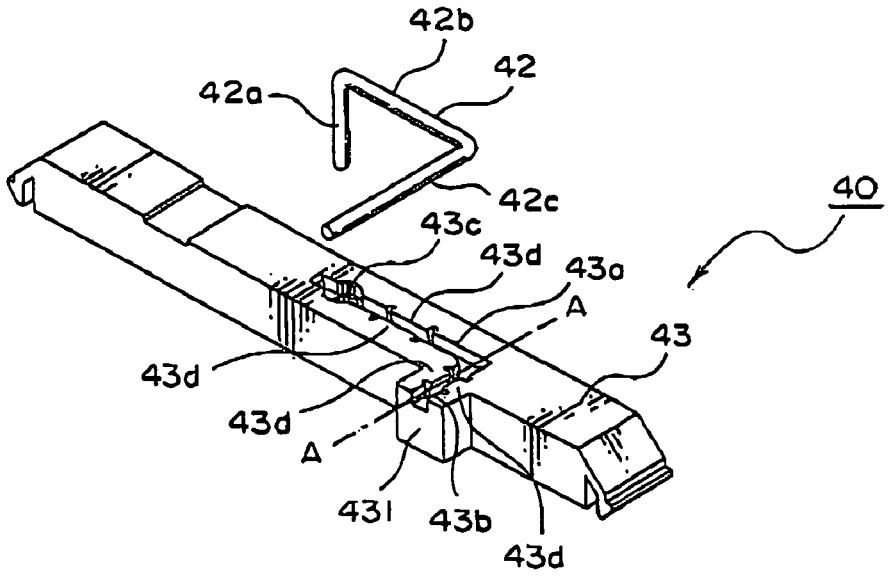
FIG. 5 is an exploded perspective view showing a structure of a feeding component used in a satellite signal receiving antenna unit according to a first embodiment of this invention.
Figure 6:
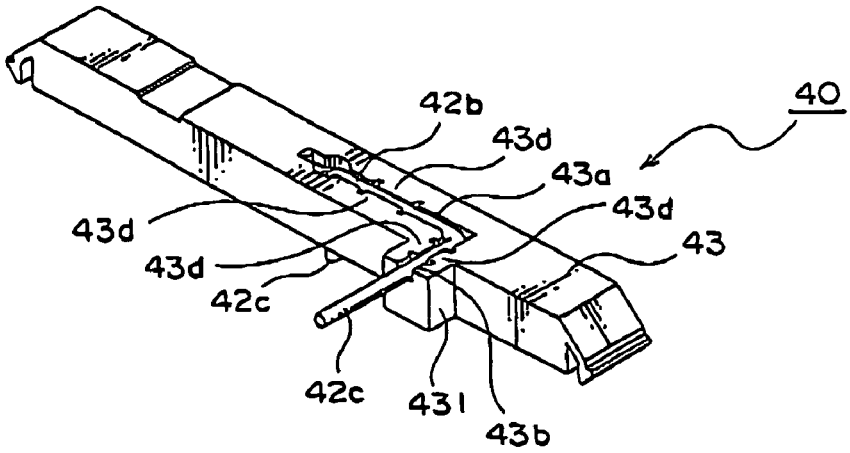
FIG. 6 is an oblique perspective view of the feeding component shown in FIG. 5.
Figure 7:
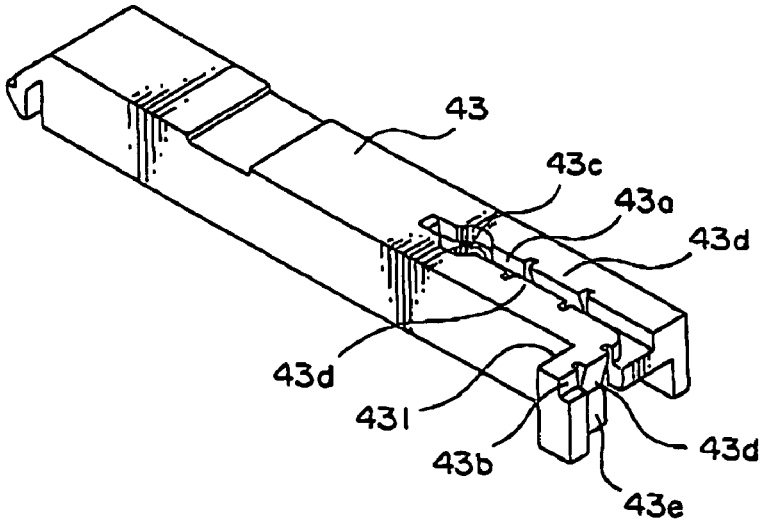
FIG. 7 is an oblique perspective view of a attaching member used for the feeding component of FIG. 5, showing a partial cross section taken along an A-A line of FIG. 5.

Referring to FIGS. 5 to 7, a description will be made of a feeding component 40 according to a first embodiment of this invention. The feeding component 40 may be used in the satellite signal receiving antenna unit as illustrated in FIG. 1.

As shown in FIG. 5, the feeding component 40 has a feeding line (or a feeding probe) 42 made of metal and an attaching member 43 made of resin.

The feeding line 42 has a shape bent at two points on the square. Accordingly, the feeding line 42 has a base end portion 42*a* bent in a vertical direction, a supporting portion 42*b* continuing on the base end portion 42*a* and extending on a horizontal plane, and a feeding portion 42*c* bent at a right angle with the supporting portion 42*b* on the horizontal plane. The supporting portion 42*b* may be called a feeding portion together with the feeding portion 42*c*.

The attaching member 43 is a molding body having an almost rectangular parallelepiped shape. At the upper side of the attaching member 43, a first wire receiving groove 43*a* for receiving the supporting portion 42*b* of the feeding line 42 is formed along a longitudinal direction. At one of ends of the first wire receiving groove 43*a*, a second wire receiving groove 43*b* perpendicular to the first wire receiving groove 43*a* is formed to correspond to the feeding portion 42*c* perpendicular to the supporting portion 42*b*.

The attaching member 43 provides a wire holding protrusion 431 while the second wire receiving groove 43*b* extends at a surface of the wire holding protrusion 431.

At the other end of the first wire receiving groove 43*a*, a through hole 43*c* is bored through the center of the attaching member 43 along the vertical direction. The through hole 43*c* is for receiving the base end portion 42*a* of the feeding line 42. The base end portion 42*a* inserted into the through hole 43*c* may be connected to a circuit board (not shown) to serve as an signal output electrode of the feeding line 42.

Two pairs of wire fixing parts 43*d* are formed on inner walls of the wire receiving grooves 43*a* and 43*b*.

As depicted in FIG. 6, the pair of the wire fixing parts 43*d* located in the first wire receiving groove 43*a* is used for holding the supporting portion 42*b* of the feeding line 42 while the other pair of the wire fixing parts 43*d* located in the second wire receiving groove 43*b* is used for the feeding portion 42*c* of the feeding line 42.

Figure 8:
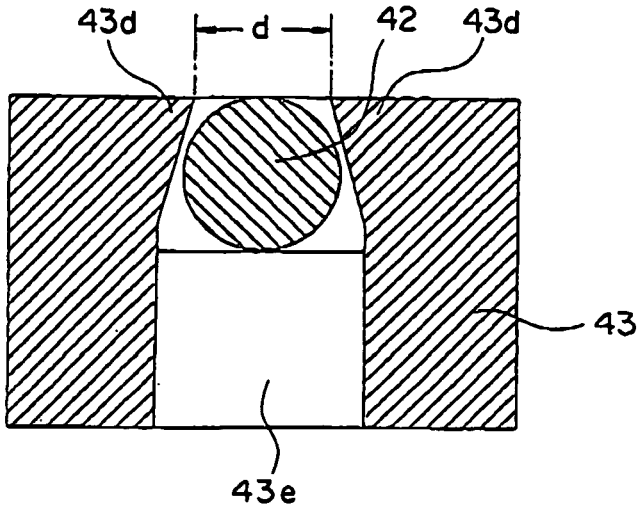
FIG. 8 is a cross sectional view of wire fixing parts provided by a attaching member and a feeding line of the feeding component shown in FIG. 5.

The wire fixing parts 43*d* of each pair are opposite to each other and inclined to narrow a space between them at a top surface side of the attaching member 43. In other words, the wire fixing parts are inclined inward to narrow a width of the wire receiving groove with increasing proximity to an upper side of the wire receiving groove 43*a* or 43*b*. That is, each of the wire fixing parts 43*d* has an inverted triangle shape as illustrated in FIGS. 7 and 8. Because of the shape, the pairs of wire fixing parts 43*d* can allow the feeding line 42 to be put into the wire receiving grooves 43*a* and 43*b* and prevent the feeding line 42 from falling away from the attaching member 43.

The attaching member 43 further provides openings 43*e* corresponding to the pairs of the wire fixing parts 43*d*. The openings 43*e* facilitate transformation of attaching member 43 when the feeding line 42 is put into the wire receiving grooves 43*a* and 43*b*. That is, the openings 43*e* facilitate putting the feeding line 42 into wire receiving grooves 43*a* and 43*b*.

In this embodiment, to make easy to put the feeding line 42 into wire receiving grooves 43*a* and 43*b*, a distance D between the pair of the wire fixing parts 43*d* at the top surface of the attaching member 43 is in a range from $\phi/1.09$ to $\phi/1.2$, where $\phi$ represents the diameter of the feeding line 42. When the distance D is larger than $\phi/1.09$, the feeding line 42 is easy to fall away from the attaching member 43. To the contrary, when the distance D is smaller than $\phi/1.2$, the feeding line 42 is hard to be put into the first and the second wire receiving grooves 43*a* and 43*b* of the attaching member 43. For instance, when the feeding line 42 is 1.2 [mm] in diameter, the distance D between the wire fixing parts 43*d* opposite to each other is set to a value of a range from 1.0 [mm] to 1.1 [mm].

As mentioned above, according to this embodiment, the feeding line 42 can be easily put input the wire receiving grooves 43*a* and 43*b* of the attaching member 43 and stably held in them because the pair of the wire fixing parts 43*d* is provided in each of the wire receiving grooves 43*a* and 43*b*.

According to the structure mentioned above, it is unnecessary to affix a tape to further stabilize the attaching state of the feeding line put in the attaching member. Therefore, the number of parts for the feeding component 40 is reduced. In addition, because the tape is unnecessary, a tape affixing process is unnecessary for manufacturing the feeding component 40 and thereby the number of assembly processes of the satellite signal receiving antenna unit is reduced.

That is, according to this invention, the feeding component 40 can be assembled by merely putting the feeding line 42 into the wire receiving grooves 43*a* and 43*b* of the attaching member 43 and thereby reduction of the number of the parts and simplification of the manufacturing process of the feeding component 40 are implemented.

Figure 9:
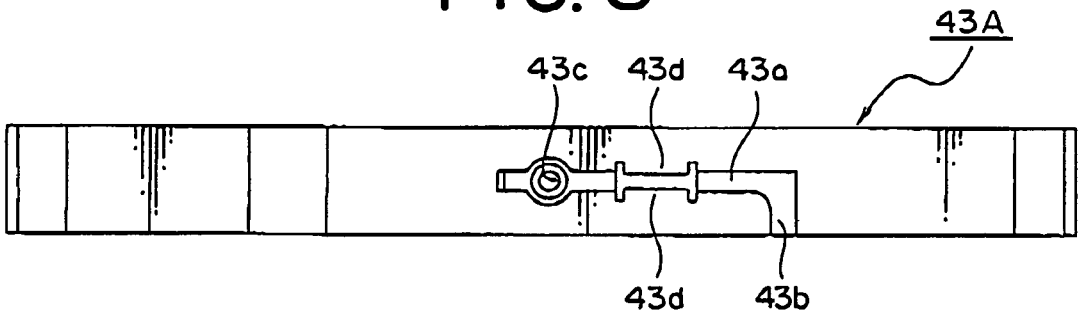
FIG. 9 is a top plan view of a attaching member used for a feeding component according to a second embodiment of this invention.

FIG. 9 is a top plan view of an attaching member 43A used in a feeding component according to a second embodiment of this invention. The attaching member 43A is similar to the attaching member 43 shown in FIGS. 5 to 7 except that the wire holding protrusion 431 is removed and thereby one pair of the wire fixing parts 43*d* is provided in one location.

That is, in the attaching member 43A, the pair of the wire fixing parts 43*d* is provided in the wire receiving groove 43*a*.

According to the structure mentioned above, the feeding line 42 (see FIG. 5) can be easily put input the wire receiving grooves 43*a* and 43*b* of the attaching member 43A and stably held in them, similarly as for the case of the attaching member 43.

Figure 10:
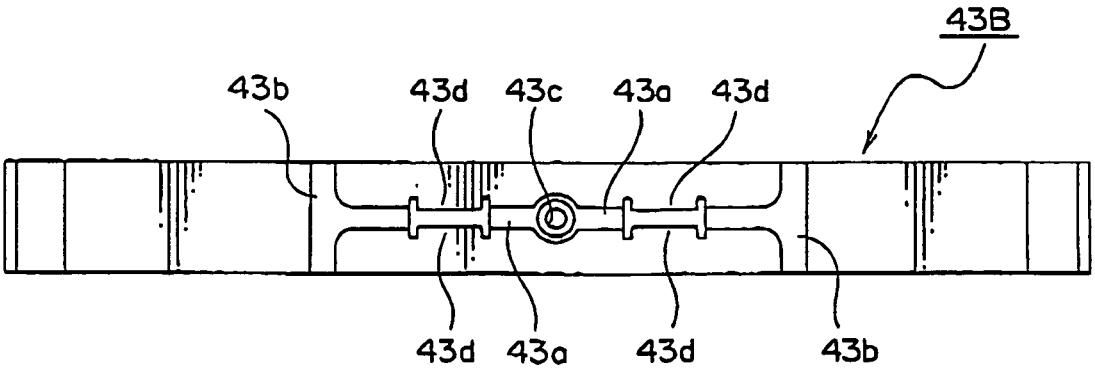
FIG. 10 is a top plan view of a attaching member used for a feeding component according to a third embodiment of this invention.

FIG. 10 is a top plan view of an attaching member 43B used in a feeding component according to a third embodiment of this invention. The attaching member 43B can receive either of feeding lines 42 having symmetric shapes.

In particular, the attaching member 43B is a molding body having an almost rectangular parallelepiped shape. At the upper side of the attaching member 43B, a first wire receiving groove 43*a* for receiving the supporting portion 42*b* of the feeding line 42 (see FIG. 5) is formed along a longitudinal direction from the center toward the both sides. At the ends of the first wire receiving groove 43*a*, to correspond to the feeding portion 42*c* perpendicular to the supporting portion 42*b*, second wire receiving grooves 43*b* perpendicular to the first wire receiving groove 43*a* are formed along a width direction to stretch over total width of the attaching member 43. Here, to deal with the feeding portion 42*c* bent toward either of right and left hand directions regarding the supporting portion 42*b*, the second wire receiving grooves 43*b* are formed to stretch over total width of the attaching member 43. The wire receiving grooves 43*a* and 43*b* allow attaching either of the feeding lines 42 bent in the right and the left hand directions symmetrically to the attaching member 43B.

At the middle of the first wire receiving groove 43*a*, a through hole 43*c* is bored through the attaching member 43B along the vertical direction. The through hole 43*c* is for receiving the base end portion 42*a* of the feeding line 42. The base end portion 42*a* inserted into the through hole 43*c* may be connected to a circuit board (not shown) to serve as an signal output electrode of the feeding line 42.

Two pairs of wire fixing parts 43*d* are formed on inner walls defining the wire receiving grooves 43*a* symmetrically. Each pair of the wire fixing parts 43*d* is for holding the supporting portion 42*b* put into the first wire receiving groove 43*a*.

According to the structure mentioned above, the feeding line 42 (see FIG. 5) can be easily put input the wire receiving grooves 43*a* and 43*b* of the attaching member 43B and stably held in them, similarly as for the cases of the attaching members 43 and 43A.

While this invention has thus far been described in conjunction with the preferred embodiments thereof, it will readily be possible for those skilled in the art to put this invention into practice in various other manners. For example, the number of the pairs of the wire fixing parts is not limited in one or two and may be equal to three or more.

What is claimed is:

1. An antenna unit comprising:

a first metal plate as a ground electrode;

a second metal plate opposite to said first metal plate; and a feeding component located between said first metal plate and said second metal plate, including a wire and an attaching member made of resin, wherein said wire has a base end portion and a feeding portion which is continuous with said base end portion and which extends in a plane, and wherein said attaching member provides a through hole for receiving said base end portion and a wire receiving groove for supporting said feeding portion, and has a pair of wire fixing parts which are formed on inner walls defining said wire receiving groove, and wherein said wire fixing parts are opposite to each other and inclined inward to narrow a width of said wire receiving groove with increasing proximity to an upper side of said wire receiving groove.

2. An antenna unit claimed in claim 1, wherein a distance between said wire fixing parts is in a range from $\phi/1.09$ to $\phi/1.2$, where $\phi$ represents a diameter of said wire.

3. An antenna unit claimed in claim 1, wherein said attaching member provides an opening corresponding to said wire fixing parts at a bottom of said wire receiving groove.

4. An antenna unit claimed in claim 1, wherein said wire has one of two symmetric shapes while said wire receiving groove is formed to receive said wire regardless of the shape.

5. A feeding component comprising:

a wire having a base end portion and a feeding portion which is continuous with said base end portion and which extends in a plane; and an attaching member made of resin, providing a through hole for receiving said base end portion and a wire receiving groove for supporting said feeding portion, and having a pair of wire fixing parts which is formed on inner walls defining said wire receiving groove, wherein said wire fixing parts are opposite to each other and inclined inward to narrow a width of said wire receiving groove with increasing proximity to an upper side of said wire receiving groove.

6. A feeding component claimed in claim 5, wherein a distance between said wire fixing parts is in a range from $\phi/1.09$ to $\phi/1.2$, where $\phi$ represents a diameter of said wire.

7. A feeding component claimed in claim 5, wherein said attaching member provides an opening corresponding to said wire fixing parts at a bottom of said wire receiving groove.

8. A feeding component claimed in claim 5, wherein said wire has one of symmetric shapes while said wire receiving groove is formed to receive said wire regardless of the shape.

* * * * *